US010777131B2

(12) United States Patent
Kim et al.

(10) Patent No.: US 10,777,131 B2
(45) Date of Patent: Sep. 15, 2020

(54) PIXEL AND ORGANIC LIGHT EMITTING DISPLAY DEVICE INCLUDING THE SAME

(71) Applicant: SAMSUNG DISPLAY CO., LTD., Yongin-si, Gyeonggi-do (KR)

(72) Inventors: Keum Nam Kim, Yongin-si (KR); Dong Woo Kim, Yongin-si (KR); Yang Hwa Choi, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 346 days.

(21) Appl. No.: 15/215,476

(22) Filed: Jul. 20, 2016

(65) Prior Publication Data

US 2017/0032739 A1 Feb. 2, 2017

(30) Foreign Application Priority Data

Jul. 31, 2015 (KR) ..... 10-2015-0108614

(51) Int. Cl.

| | |
|---|---|
| ***G09G 3/3233*** | (2016.01) |
| ***G09G 3/3266*** | (2016.01) |
| ***G09G 3/3258*** | (2016.01) |
| ***G09G 3/3275*** | (2016.01) |

(52) U.S. Cl.

CPC ..... *G09G 3/3233* (2013.01); *G09G 3/3258* (2013.01); *G09G 3/3266* (2013.01); *G09G 3/3275* (2013.01); *G09G 2320/0233* (2013.01)

(58) Field of Classification Search

CPC .. G09G 3/3233; G09G 3/3266; G09G 3/3258; G09G 3/3275; G09G 2320/0233

See application file for complete search history.

(56) References Cited

U.S. PATENT DOCUMENTS

| | | | | |
|---|---|---|---|---|
| 7,916,102 | B2 * | 3/2011 | Chung | G09G 3/3233 345/76 |
| 8,289,236 | B2 * | 10/2012 | Yamamoto | G09G 3/3233 345/76 |
| 8,552,943 | B2 | 10/2013 | Chung | |
| 8,866,705 | B2 | 10/2014 | Takasugi et al. | |
| 9,035,976 | B2 * | 5/2015 | Lee | G09G 3/3283 345/691 |
| 9,099,417 | B2 * | 8/2015 | Yin | G09G 3/325 |
| 9,805,654 | B2 * | 10/2017 | Yang | G09G 3/3233 |

(Continued)

FOREIGN PATENT DOCUMENTS

| | | |
|---|---|---|
| KR | 10-2008-0067856 A | 7/2008 |
| KR | 10-2011-0053708 A | 5/2011 |
| KR | 10-2011-0127006 A | 11/2011 |

*Primary Examiner* — Jeff Piziali

(74) *Attorney, Agent, or Firm* — Lewis Roca Rothgerber Christie LLP

(57) ABSTRACT

A pixel of an organic light emitting display device includes a first transistor connected between a data line and a first node, a second transistor connected between a second node and a third node, a third transistor connected between the second node and a fourth node, a fourth transistor connected between the first node and the second node, a fifth transistor connected between the third node and an initializing power source, a sixth transistor connected between a first power source and the third node, a capacitor connected between the first node and the fourth node, and an organic light emitting diode (OLED) connected between the second node and a second power source.

20 Claims, 4 Drawing Sheets

(56) References Cited

U.S. PATENT DOCUMENTS

| | | | | |
|---|---|---|---|---|
| 2007/0273619 | A1* | 11/2007 | Kitazawa | G09G 3/3233 345/76 |
| 2008/0048955 | A1* | 2/2008 | Yumoto | G09G 3/3233 345/82 |
| 2008/0150843 | A1 | 6/2008 | Yamamoto et al. | |
| 2010/0001983 | A1* | 1/2010 | Abe | G09G 3/3233 345/211 |
| 2011/0115772 | A1* | 5/2011 | Chung | G09G 3/3233 345/211 |
| 2011/0285691 | A1* | 11/2011 | Takasugi | G09G 3/3233 345/212 |
| 2011/0304593 | A1* | 12/2011 | Huang | G09G 3/3225 345/204 |
| 2013/0241916 | A1* | 9/2013 | Takasugi | G09G 3/3233 345/212 |
| 2014/0022289 | A1 | 1/2014 | Lee et al. | |

* cited by examiner

PIXEL AND ORGANIC LIGHT EMITTING DISPLAY DEVICE INCLUDING THE SAME

CROSS-REFERENCE TO RELATED APPLICATION

This application claims priority to and the benefit of Korean Patent Application No. 10-2015-0108614, filed on Jul. 31, 2015, in the Korean Intellectual Property Office, the entire contents of which are incorporated herein by reference in their entirety.

BACKGROUND

1. Field

An aspect of embodiments of the present invention relates to a display device, and more particularly, to a pixel and an organic light emitting display device including the same.

2. Description of the Related Art

An organic light emitting display device displays an image by using an organic light emitting diode (OLED) that generates light by re-combination of electrons and holes. The organic light emitting display device has a high response speed and may display a clear image.

In general, the organic light emitting display device includes a plurality of pixels each having a driving transistor and an OLED. Each pixel may emit light at one of a plurality of different gray levels controlling an amount of current supplied to the OLED by using the driving transistor.

However, due to deviations (or variations) in the threshold voltages of the driving transistors included in the pixels, an image with non-uniform brightness may be displayed.

SUMMARY

An aspect of an embodiment of the present invention relates to a pixel capable of reducing or preventing non-uniformity in brightness from occurring due to deviation (or variation) in threshold voltages of driving transistors.

Another embodiment of the present invention relates to an organic light emitting display device capable of reducing or preventing non-uniformity in brightness from occurring due to deviation (or variation) in threshold voltages of driving transistors.

A pixel circuit according to an embodiment of the present invention includes a first transistor connected between a data line and a first node, a second transistor connected between a second node and a third node, a third transistor connected between the second node and a fourth node, a fourth transistor connected between the first node and the second node, a fifth transistor connected between the third node and an initializing power source, a sixth transistor connected between a first power source and the third node, a capacitor connected between the first node and the fourth node, and an organic light emitting diode (OLED) connected between the second node and a second power source.

The first transistor may include a first electrode connected to the data line, a second electrode connected to the first node, and a gate electrode connected to a first control line. The second transistor may include a first electrode connected to the third node, a second electrode connected to the second node, and a gate electrode connected to the fourth node. The third transistor may include a first electrode connected to the fourth node, a second electrode connected to the second node, and a gate electrode connected to the first control line. The fourth transistor may include a first electrode connected to the first node, a second electrode connected to the second node, and a gate electrode connected to a second control line. The fifth transistor may include a first electrode connected to the third node, a second electrode connected to the initializing power source, and a gate electrode connected to the first control line. The sixth transistor may include a first electrode connected to the first power source, a second electrode connected to the third node, and a gate electrode connected to the second control line.

The first control line is a scan line connected to the pixel circuit and the second control line is an emission control line connected to the pixel circuit.

The first, second, third, fourth, fifth, and sixth transistors may be n channel type transistors.

The pixel circuit may operate in a unit period sequentially including a first period, a second period, a third period, and a fourth period. The first transistor, the third transistor, and the fifth transistor may be turned on during the second period in the unit period. The fourth transistor and the sixth transistor may be turned on during the fourth period in the unit period.

when the first, second, third, fourth, fifth and sixth transistors are turned off during the first period, a voltage of the second node may be maintained at a threshold voltage level of the OLED.

When the third transistor may be turned on during the second period, the gate electrode of the second transistor and the second electrode of the second transistor may be connected to each other to diode-connected the second transistor.

The initializing power source may have the same voltage level as the second power source.

Active layers of the first, second, third, fourth, fifth, and sixth transistors may include an oxide semiconductor.

An organic light emitting display device according to another embodiment of the present invention includes a plurality of pixel circuits connected to n (n is a natural number of no less than 2) scan lines, m (m is a natural number of no less than 2) data lines, and n control lines, a scan driver configured to supply a plurality of scan signals to the scan lines, a data driver configured to supply a plurality of data signals to the data lines, and a control driver configured to supply a plurality of control signals to the control lines. A pixel circuit connected to an ith (i is a natural number of no more than n) scan line, an ith control line, and a jth (j is a natural number of no more than m) data line includes a first transistor connected between the jth data line and a first node and is configured to be turned on in response to a scan signal supplied to the ith scan line, a second transistor connected between a second node and a third node, a third transistor connected between the second node and a fourth node and is configured to be turned on in response to the scan signal supplied to the ith scan line, a fourth transistor connected between the first node and the second node and is configured to be turned on in response to a control signal supplied to the ith control line, a fifth transistor connected between the third node and an initializing power source and is configured to be turned on in response to the scan signal supplied to the ith scan line, a sixth transistor connected between a first power source and the third node and is configured to be turned on in response to the control signal supplied to the ith control line, a capacitor connected between the first node and the fourth node, and an OLED connected between the second node and a second power source.

The first transistor may include a first electrode connected to the jth data line, a second electrode connected to the first node, and a gate electrode connected to the ith scan line. The second transistor may include a first electrode connected to the third node, a second electrode connected to the second node, and a gate electrode connected to the fourth node. The third transistor may include a first electrode connected to the fourth node, a second electrode connected to the second node, and a gate electrode connected to the ith scan line. The fourth transistor may include a first electrode connected to the first node, a second electrode connected to the second node, and a gate electrode connected to the ith control line. The fifth transistor may include a first electrode connected to the third node, a second electrode connected to the initializing power source, and a gate electrode connected to the ith scan line. The sixth transistor may include a first electrode connected to the first power source, a second electrode connected to the third node, and a gate electrode connected to the ith control line.

The first, second, third, fourth, fifth, and sixth transistors may be n channel type transistors.

The organic light emitting display device may operate in a unit period including first, second, third, and fourth periods. The ith scan line may receive a scan signal during the second period. The jth data line may receive a data signal during the second period. The ith control line may receive a control signal during the fourth period.

The initializing power source has the same voltage level as the second power source.

Active layers of the first, second, third, fourth, fifth, and sixth transistors may include an oxide semiconductor.

In a pixel according to an embodiment of the present invention, because a driving current supplied to an OLED is determined regardless of a threshold voltage of a driving transistor, it is possible to reduce or prevent non-uniformity in brightness from occurring due to deviation (or variation) in threshold voltages of driving transistors.

In an organic light emitting display device according to another embodiment of the present invention, because driving currents supplied to OLEDs of pixels included in the organic light emitting display device are determined regardless of threshold voltages of driving transistors, it is possible to reduce or prevent non-uniformity in brightness from occurring due to deviation (or variation) in the threshold voltages of the driving transistors.

BRIEF DESCRIPTION OF THE DRAWINGS

The accompanying drawings, together with the specification, illustrate exemplary embodiments of the present invention, and, together with the description, serve to explain the principles of the present invention.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
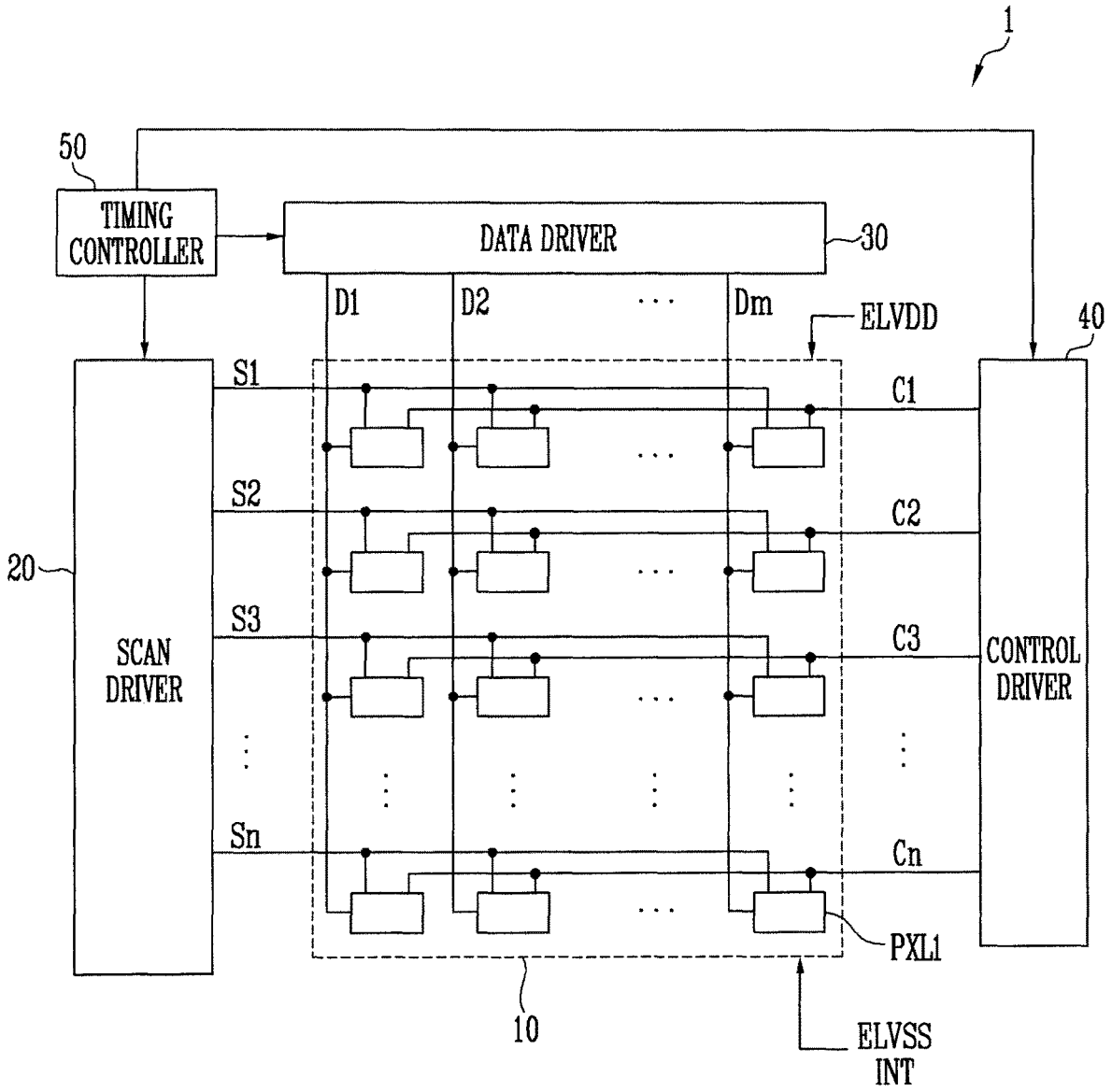
FIG. 1 is a block diagram illustrating an organic light emitting display device according to an embodiment of the present invention.

Embodiments of the present invention will now be described more fully hereinafter with reference to the accompanying drawings; however, they may be embodied in different forms and should not be construed as limited to the embodiments set forth herein. Rather, these embodiments are provided so that this disclosure will be thorough and complete, and will full convey the scope of the example embodiments to those skilled in the art.

It will be understood that when an element is referred to as being "connected to" another element, it can be directly connected to the element, or one or more intervening elements may also be present. Like reference numerals refer to like elements throughout.

Hereinafter, a pixel according to an embodiment of the present invention and an organic light emitting display device including the same will be described with reference to the accompanying drawings.

FIG. 1 is a block diagram illustrating an organic light emitting display device 1 according to an embodiment of the present invention.

Referring to FIG. 1, the organic light emitting display device 1 may include a pixel area 10 including a plurality of pixels PXL1, a scan driver 20, a data driver 30, a control driver 40, and a timing controller 50.

In addition, the organic light emitting display device 1 may further include n scan lines S1 to Sn connected between the scan driver 20 and the pixels PXL1, m data lines D1 to Dm connected between the data driver 30 and the pixels PXL1, and n control lines C1 to Cn connected between the control driver 40 and the pixels PXL1 (here, n and m are natural numbers of no less than 2). In the present specification, the control lines C1 to Cn may be referred to as emission control lines.

The pixel area 10 including the pixels PXL1 may be connected to the n scan lines S1 to Sn, the m data lines D1 to Dm, and the n control lines C1 to Cn in order to drive the pixels PXL1.

For example, each pixel of the pixels PXL1 may be connected to a scan line, a data line, and a control line.

For example, pixels PXL1 positioned in an kth line may be connected to an kth scan line Sk and an kth control line Ck (here, k is a natural number of no more than n).

The pixels PXL1 may receive a first power from a first power source ELVDD, a second power from a second power source ELVSS, and an initializing power from an initializing power source INT. In FIG. 1, it is illustrated that the second power source ELVSS and the initializing power source INT are independent power sources. However, according to some embodiments, the second power source ELVSS and the initializing power source INT may be the same power source.

In addition, the pixels PXL1 may respectively generate light having components (e.g., red, green, and blue components) corresponding to data signals by currents that flow from the first power source ELVDD to the second power source ELVSS via organic light emitting diodes (OLED).

The scan driver 20 generates scan signals by control of the timing controller 50 and may supply the generated scan signals to the scan lines S1 to Sn.

Therefore, the pixels PXL1 may receive the scan signals through the scan lines S1 to Sn.

Figure 2:
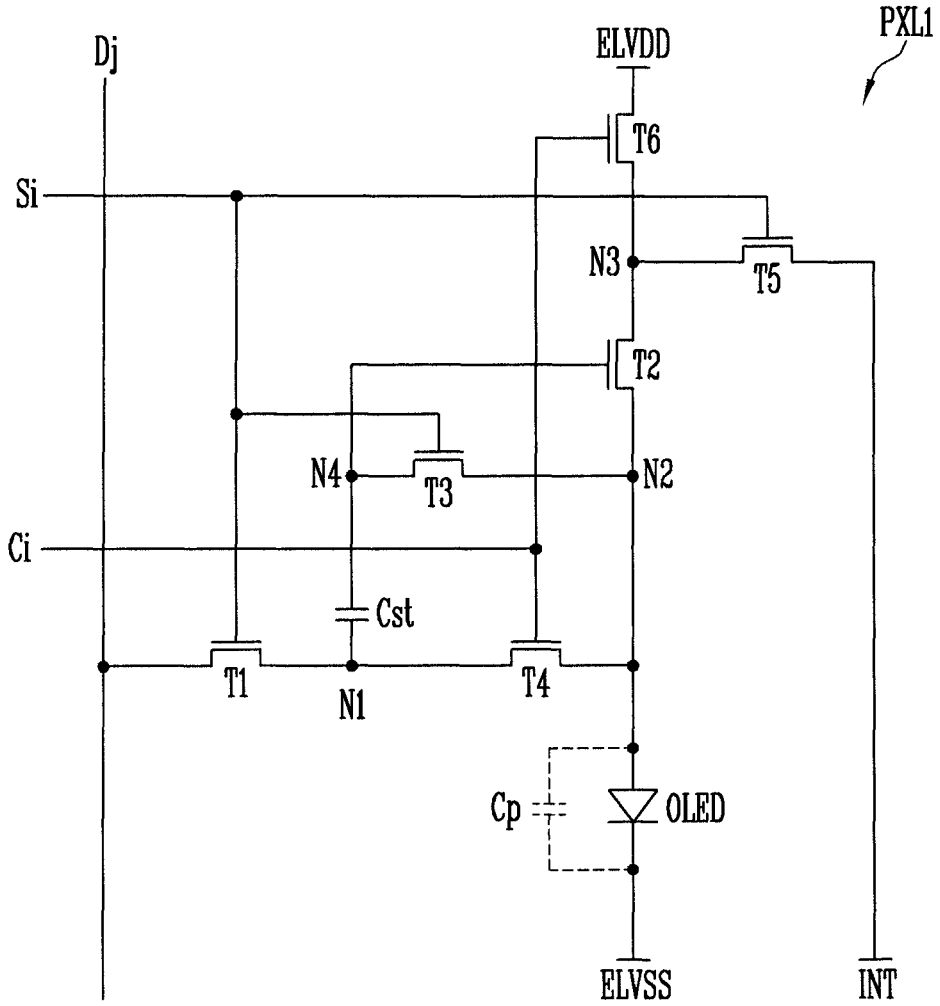
FIG. 2 is a circuit diagram illustrating a pixel circuit according to an embodiment of the present invention.

FIG. 2 is a circuit diagram illustrating a pixel (or a pixel circuit) according to an embodiment of the present invention. The pixel PXL1 of FIG. 2 is positioned in an ith (i is a natural number of no more than n) row and a jth a is a natural number of no more than m) column in the pixel area 10 of the organic light emitting display device 1.

Referring to FIG. 2, the pixel (or pixel circuit) PXL1 includes a first transistor T1, a second transistor T2, a third transistor T3, a fourth transistor T4, a fifth transistor T5, a sixth transistor T6, a capacitor Cst, and an OLED OLED.

The first transistor T1 may be connected between a jth data line Dj and a first node N1.

For example, a first electrode of the first transistor T1 is connected to the jth data line Dj, a second electrode thereof is connected to the first node N1, and a gate electrode thereof may be connected to an ith scan line Si.

Therefore, the first transistor T1 may be turned on in response to a scan signal supplied to the ith scan line Si.

When the first transistor T1 is turned on, a data signal of the jth data line Dj may be transmitted to the first node N1.

The second transistor T2 may be connected between a second node N2 and a third node N3.

For example, a first electrode of the second transistor T2 is connected to the third node N3, a second electrode thereof is connected to the second node N2, and a gate electrode thereof may be connected to a fourth node N4.

The second transistor T2 may function as a driving transistor for supplying a driving current to the OLED OLED.

For example, the second transistor T2 may supply the driving current in accordance with (or corresponding to) a voltage stored in the capacitor Cst to the OLED OLED.

The third transistor T3 may be connected between the second node N2 and the fourth node N4.

For example, a first electrode of the third transistor T3 is connected to the fourth node N4, a second electrode thereof is connected to the second node N2, and a gate electrode thereof may be connected to the ith scan line Si.

Therefore, the third transistor T3 may be turned on in response to the scan signal supplied to the ith scan line Si.

When the third transistor T3 is turned on, the second electrode of the second transistor T2 and the gate electrode thereof may be electrically connected to each other. Therefore, when the third transistor T3 is turned on, the second transistor T2 may be diode connected.

The fourth transistor T4 may be connected between the first node N1 and the second node N2.

For example, a first electrode of the fourth transistor T4 is connected to the first node N1, a second electrode thereof is connected to the second node N2, and a gate electrode thereof may be connected to an ith control line Ci.

Therefore, the fourth transistor T4 may be turned on in response to a control signal supplied to the ith control line Ci. When the fourth transistor T4 is turned on, the first node N1 and the second node N2 may be electrically connected.

The fifth transistor T5 may be connected between the third node N3 and the initializing power source INT.

For example, a first electrode of the fifth transistor T5 is connected to the third node N3, a second electrode thereof is connected to the initializing power source INT, and a gate electrode thereof may be connected to the ith scan line Si.

Therefore, the fifth transistor T5 may be turned on in response to the scan signal supplied to the ith scan line Si. When the fifth transistor T5 is turned on, a voltage of the initializing power source INT (e.g., the initializing power) may be transmitted to the third node N3.

The sixth transistor T6 may be connected between the first power source ELVDD and the third node N3.

For example, a first electrode of the sixth transistor T6 is connected to the first power source ELVDD, a second electrode thereof is connected to the third node N3, and a gate electrode thereof may be connected to the ith control line Ci.

Therefore, the sixth transistor T6 may be turned on in response to the control signal supplied to the ith control line Ci. When the sixth transistor T6 is turned on, a voltage of the first power source ELVDD may be transmitted to the third node N3.

Here, the first electrodes of the transistors T1, T2, T3, T4, T5, and T6 are source electrodes or drain electrodes and the second electrodes thereof may be electrodes different from the first electrodes (e.g., drain electrodes or source electrodes).

For example, when the first electrodes are set as the drain electrodes, the second electrodes may be set as the source electrodes.

All the transistors T1, T2, T3, T4, T5, and T6 included in the pixel PXL1 may have the same channel type.

For example, the transistors T1, T2, T3, T4, T5, and T6 may be n channel type transistors so that the transistors T1, T2, T3, T4, T5, and T6 may be implemented by amorphous silicon thin film transistor (a-Si TFT) and oxide thin film transistor (oxide TFT) as well as polycrystalline-silicon thin film transistor (poly-Si TFT).

An n channel type transistor may be turned off when a control signal is at a low level and may be turned on when the control signal is at a high level. In addition, the n channel type transistor has a higher operation speed than a p channel type transistor and is advantageous to manufacturing a large area display device.

For example, electrons have higher mobility than holes. Because the n channel type transistor uses the electrons as a charge carrier, the n channel type transistor has a higher speed of response to the control signal than the p channel type transistor that uses the holes as a charge carrier.

In particular, when the transistors T1, T2, T3, T4, T5, and T6 are implemented by the oxide TFT, active layers of the transistors T1, T2, T3, T4, T5, and T6 may include oxide semiconductor.

The oxide semiconductor may include at least one among an oxide based on titanium (Ti), hafnium (Hf), zirconium (Zr), aluminum (Al), tantalum (Ta), germanium (Ge), zinc (Zn), gallium (Ga), tin (Sn), or indium (In) and compound oxides of Ti, Hf, Zr, Al, Ta, Ge, Zn, Ga, Sn, and In, for example, ZnO, $InGaZnO_4$, Zn—In—O, Zn—Sn—O, In—Ga—O, In—Sn—O, In—Zr—O, In—Zr—Zn—O, In—Zr—Sn—O, In—Zr—Ga—O, In—Al—O, In—Zn—Al—O, In—Sn—Al—O, In—Al—Ga—O, In—Ta—O, In—Ta—Zn—O, In—Ta—Sn—O, In—Ta—Ga—O, In—Ge—O, In—Ge—Zn—O In—Ge—Sn—O, In—Ge—Ga—O, Ti—In—Zn—O, and Hf—In—Zn—O.

The above-described oxide semiconductors are only exemplary and other oxide semiconductors may be used.

The capacitor Cst may be connected between the first node N1 and the fourth node N4.

For example, a first electrode of the capacitor Cst may be connected to the first node N1 and a second electrode thereof may be connected to the fourth node N4.

The organic light emitting diode OLED may be connected between the second node N2 and the second power source ELVSS.

For example, an anode electrode of the OLED OLED is connected to the second node N2 and a cathode electrode thereof may be connected to the second power source ELVSS.

The OLED OLED receives the driving current from the second transistor T2 and may emit light having a brightness (or luminance) corresponding to the driving current.

In addition, as marked with a dotted line, a parasitic capacitor (or parasitic capacitance) Cp may exist in the OLED OLED.

The first transistor T1, the fourth transistor T4, and the capacitor Cst may be commonly connected to the first node N1.

For example, the second electrode of the first transistor T1, the first electrode of the fourth transistor T4, and the first electrode of the capacitor Cst may be commonly connected to the first node N1.

The second transistor T2, the third transistor T3, the fourth transistor T4, and the OLED OLED are commonly connected to the second node N2.

For example, the second electrode of the second transistor T2, the second electrode of the third transistor T3, the second electrode of the fourth transistor T4, and the anode electrode of the OLED OLED may be commonly connected to the second node N2.

The second transistor T2, the fifth transistor T5, and the sixth transistor T6 are commonly connected to the third node N3.

For example, the first electrode of the second transistor T2, the first electrode of the fifth transistor T5, and the second electrode of the sixth transistor T6 may be commonly connected to the third node N3.

The second transistor T2, the third transistor T3, and the capacitor Cst are commonly connected to the fourth node N4.

For example, the gate electrode of the second transistor T2, the first electrode of the third transistor T3, and the second electrode of the capacitor Cst are commonly connected to the fourth node N4.

In one embodiment, the first power source ELVDD is a high potential power source configured to output a positive voltage and the second power source ELVSS is a low potential power source configured to output a negative voltage or a ground voltage.

In addition, the initializing power source INT may be a low potential power source and may have a voltage level different from or the same as that of the second power source ELVSS.

Figure 3:
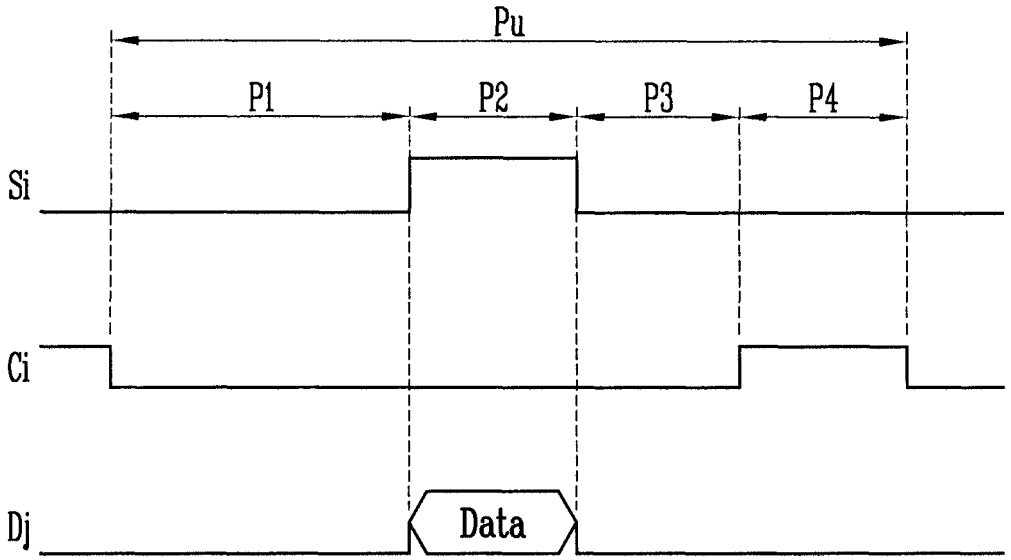
FIG. 3 is a timing diagram illustrating a method of driving a pixel according to an embodiment of the present invention.

FIG. 3 is a timing diagram illustrating a method of driving a pixel according to an embodiment of the present invention.

Referring to FIGS. 2 and 3, driving operation of the pixel PXL1 in a unit period Pu will be described.

Referring to FIG. 3, the method of driving the pixel PXL1 according to one embodiment of the present invention may include an initializing process, a threshold voltage compensating process, a data inputting process, and a light emitting process.

The initializing process may be performed in (or during) a first period P1. During the initializing process, the scan signal received through the ith scan line Si may be at a low level and the control signal received through the ith control line Ci may be at a low level. In addition, in the initializing process, a low-level signal may be supplied through the jth data line Dj. In FIG. 3, it is illustrated that the low-level signal is supplied through the jth data line Dj in the initializing process. However, because the first transistor T1 is turned off in the initializing process, even if a high-level signal is supplied through the jth data line Dj, the operation of the pixel PXL1 is not affected. For example, the signal received through the jth data line Dj in the initializing process may be a high-level signal or a low-level signal in accordance with an embodiment.

In the initializing process performed in the first period P1, because the low-level scan signal is supplied through the ith scan line Si and the low-level control signal is supplied through the ith control line Ci, the first transistor T1, the third transistor T3, the fourth transistor t4, the fifth transistor T5, and the sixth transistor T6 may be turned off. In this case, the second node N2 connected to the anode electrode of the OLED OLED may maintain a voltage value (e.g., a predetermined voltage value). For example, the second node N2 may maintain a threshold voltage value EL_Vth of the OLED OLED.

The threshold voltage compensating process and the data inputting process may be performed in (or during) a second period P2. In the threshold voltage compensating process and the data inputting process, the scan signal received through the ith scan line Si may be a high-level signal and the control signal received through the ith control line Ci may be a low-level signal. In addition, in the threshold voltage compensating process and the data inputting process, a data signal may be supplied through the jth data line Dj.

As the high-level signal is supplied through the ith scan line Si, the first transistor T1, the third transistor T3, and the fifth transistor T5 may be turned on in the second period P2. As the first transistor T1 is turned on, a data voltage Data may be transmitted to the first node N1. As the third transistor T3 is turned on, the second node N2 and the fourth node N4 may be electrically connected to each other. As the fifth transistor T5 is turned on, the voltage of the initializing power source INT may be transmitted to the third node N3.

When the low-level signal is supplied through the ith control line Ci during the second period P2, the fourth transistor T4 and the sixth transistor T6 may be turned off. When the fourth transistor T4 is turned off during the second period P2, the first node N1 and the second node N2 are not electrically connected to each other. When the sixth transistor T6 is turned off during the second period P2, the first power source ELVDD and the third node N3 are not electrically connected to each other.

During the second period P2 in which the threshold voltage compensating process and the data inputting process are performed, as the second node N2 and the fourth node N4 are electrically connected to each other, the gate electrode of the second transistor T2 and the second electrode thereof are electrically connected to each other. Therefore, the second transistor T2 is diode-connected. In the first period P1, the second node N2 maintains a voltage value (e.g., a predetermined voltage value), for example, the threshold voltage value EL_Vth of the OLED OLED. As the second transistor T2 is diode-connected and the voltage of the initializing power source INT is applied to the first electrode of the second transistor T2, the voltage value of the second node N2 changes from EL_Vth in the first period P1 when it enters the second period P2 so that a relationship defined by EQUATION 1 is established.

$$V_{N2}=V_{INT}+V_{TH} \quad \text{EQUATION 1}$$

where, $V_{N2}$ represents the voltage value of the second node N2, $V_{INT}$ represents the voltage value of the initializing power source INT, and $V_{TH}$ represents the threshold voltage value of the second transistor T2.

Because the voltage value of the second node N2 is $V_{INT}+V_{TH}$ and the data voltage is applied to the first node N1, a voltage difference between the second electrode of the capacitor Cst and the first electrode thereof has a value defined by EQUATION 2.

$$V_{Cst}=V_{INT}+V_{TH}-V_{Data} \quad \text{EQUATION 2}$$

where, $V_{Cst}$ represents the voltage difference between the second electrode of the capacitor Cst and the first electrode thereof and $V_{Data}$ represents the data voltage Data applied through the jth data line Dj.

For example, due to the threshold voltage compensating process and the data inputting process that are performed during the second period P2, a data value $V_{DATA}$ to which the threshold voltage value $V_{TH}$ of the second transistor T2 is reflected is input to both ends of the capacitor Cst.

A third period P3 exists between the second period P2 and the fourth period P4. During the third period P3, the scan signal received through the ith scan line Si may be a low-level signal and the control signal received through the ith control line Ci may be a low-level signal. During FIG. 3, it is illustrated that a low-level signal is supplied through the jth data line Dj in the third period P3. However, because the first transistor T1 is turned off in the third period P3 and the fourth period P4, even if a high-level signal is supplied through the jth data line Dj, operation of the pixel PXL1 is not affected. For example, in the third period P3 and the fourth period P4, the signal received through the jth data line Dj may be a high-level signal or a low-level signal in accordance with an embodiment.

In the third period P3, because the low-level scan signal is supplied through the ith scan line Si and the low-level control signal is supplied through the ith control line Ci, the first transistor T1, the third transistor T3, the fourth transistor T4, the fifth transistor T5, and the sixth transistor T6 may be turned off.

The third period P3 separates the second period P2 from the fourth period P4. For example, the third period P3 may be introduced so that a high-level section of the scan signal transmitted through the ith scan line Si does not overlap that of the control signal transmitted through the ith control line Ci. Therefore, according to one embodiment, the third period P3 may be maintained for a short time (e.g., the third period P3 may have a short duration).

The light emitting process may be performed during the fourth period P4. During the light emitting process, the scan signal received through the ith scan line Si may be a low-level signal and the control signal received through the ith control line Ci may be a high-level signal.

As the high-level signal is supplied through the ith control line Ci, during the fourth period P4 in which the light emitting process is performed, the fourth transistor T4 and the sixth transistor T6 may be turned on. When the fourth transistor T4 is turned on, the first node N1 and the second node N2 may be electrically connected to each other. When the sixth transistor T6 is turned on, the voltage of the first power source ELVDD may be transmitted to the third node N3.

When the low-level signal is supplied through the ith scan line Si, in the fourth period P4, the first transistor T1, the third transistor T3, and the fifth transistor T5 may be turned off. When the first transistor T1 is turned off, the first node N1 and the jth data line Dj are not electrically connected to each other. When the third transistor T3 is turned off, the second node N2 and the fourth node N4 are not electrically connected to each other. When the fifth transistor T5 is turned off, the initializing power source INT and the third node N3 are not electrically connected to each other.

A connection relationship of the pixel PXL1 in the fourth period P4 will be described based on the second transistor T2. A first electrode of the second transistor T2 is connected to the first power source ELVDD, a second electrode thereof is connected to the anode electrode of the OLED OLED and the first electrode of the capacitor Cst, and a gate electrode thereof is connected to the second electrode of the capacitor Cst.

Therefore, in the fourth period P4, the second transistor T2 may supply the driving current defined by EQUATION 3 to the OLED OLED.

$$I_o=k(V_{GS}-V_{TH})^2 \quad \text{EQUATION 3}$$

where, $I_o$ represents the driving current output from the second transistor T2 and k represents a constant.

During the fourth period P4, because the third transistor T3 is turned off and the fourth transistor T4 is turned on, $V_{GS}$ has the same value as $V_{Cst}$. Therefore, when the relationship of the EQUATION 2 is applied to the EQUATION 3, relationships defined by EQUATIONS 4, 5, and 6 may be sequentially obtained as follows.

$$I_o=k(V_{CH}-V_{TH})^2 \quad \text{EQUATION 4}$$

$$I_o=k(V_{INT}+V_{TH}-V_{Data}-V_{TH})^2 \quad \text{EQUATION 5}$$

$$I_o=k(V_{INT}-V_{Data})^2 \quad \text{EQUATION 6}$$

As shown in the EQUATION 6, the OLED OLED may emit light with brightness (or luminance) corresponding to the driving current $I_o$ in the fourth period P4. At this time, because the driving current output from the second transistor T2 is determined regardless of the threshold voltage $V_{TH}$, it is possible to reduce or prevent non-uniformity in brightness from occurring due to a deviation (or variation) in threshold voltages of the driving transistors T2 included in the pixels.

On the other hand, referring to the EQUATION 6, the current $I_o$ that flows to the OLED OLED in the fourth period P4 in which the light emitting process is performed is regardless of the first power source ELVDD. Therefore, even if there is an IR-drop of the first power source ELVDD, currents that flow through the OLEDs OLED of the pixels may be substantially uniformly maintained. In the pixel according to embodiments of the present invention and the display device including the same, because a scan signal and a control signal are used for driving a pixel so that the pixel has a simple structure, it is possible to reduce cost and time used for manufacturing the organic light emitting display device.

Figure 4:
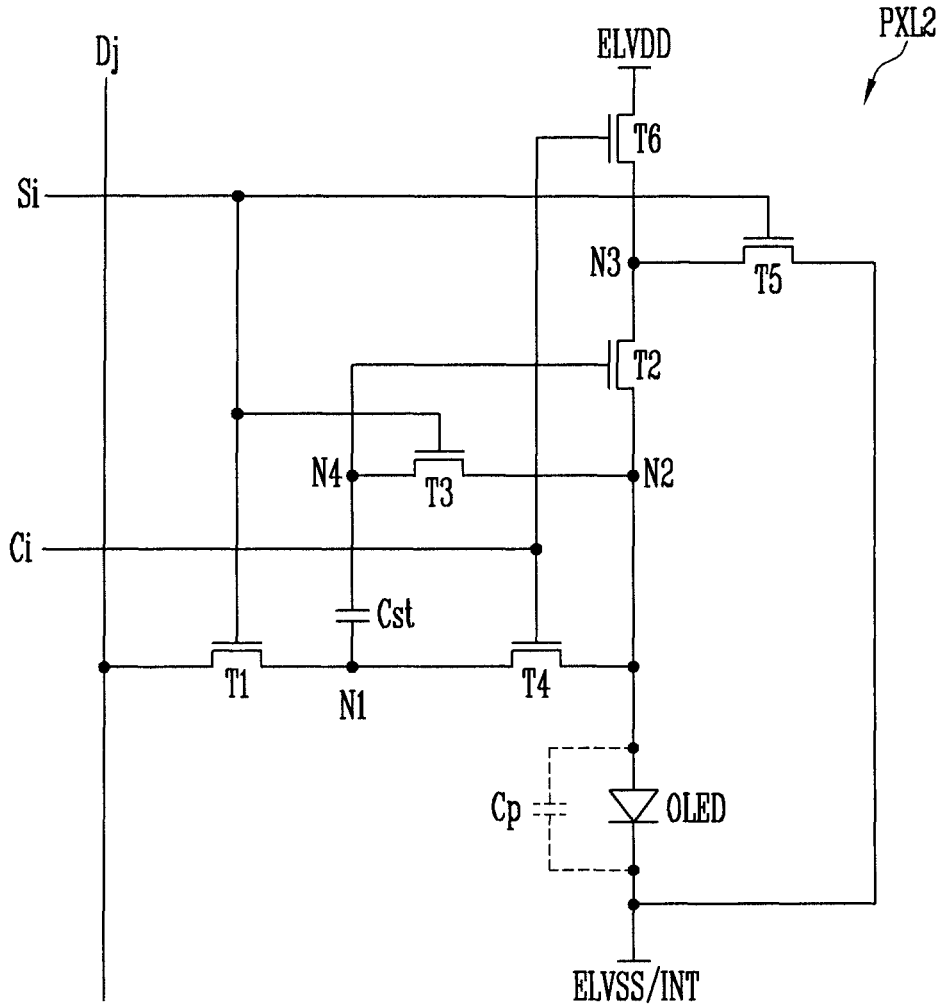
FIG. 4 is a circuit diagram illustrating a pixel according to another embodiment of the present invention.

FIG. 4 is a circuit diagram illustrating a pixel according to another embodiment of the present invention. Here, description of contents repeated to those of the above-described embodiment will not be given and description will be made base on parts different from the above-described embodiment.

According to another embodiment of the present invention, the initializing power source INT may have the same voltage level as the second power source ELVSS.

Therefore, in a pixel PXL2 according to another embodiment of the present invention, a fifth transistor T5 may be connected between a third node N3 and a second power source ELVSS.

For example, a first electrode of the fifth transistor t5 is connected to the third node N3, a second electrode thereof is connected to the second power source ELVSS, and a gate electrode thereof may be connected to the an ith scan line Si.

Because the pixel PXL2 according to the current embodiment uses a smaller number of power sources than the pixel PXL1 of FIG. 2, it is possible to easily manufacture an organic light emitting display device and to reduce manufacturing cost.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims and equivalents thereof.

What is claimed is:

1. A pixel circuit comprising:

a first transistor connected between a data line and a first node;

a second transistor connected between a second node and a third node;

a third transistor directly connecting the second node and a fourth node;

a fourth transistor directly connecting the first node and the second node;

a fifth transistor connected between the third node and an initializing power source, the fifth transistor directly connected to the third node;

a sixth transistor connected between a first power source and the third node;

a capacitor directly connecting the first node and the fourth node; and an organic light emitting diode (OLED) connected between the second node and a second power source, the second power source and the initializing power source being independent power sources.

2. The pixel circuit of claim 1, wherein the first transistor comprises a first electrode connected to the data line, a second electrode connected to the first node, and a gate electrode connected to a first control line, wherein the second transistor comprises a first electrode connected to the third node, a second electrode connected to the second node, and a gate electrode connected to the fourth node, wherein the third transistor comprises a first electrode connected to the fourth node, a second electrode connected to the second node, and a gate electrode connected to the first control line, wherein the fourth transistor comprises a first electrode connected to the first node, a second electrode connected to the second node, and a gate electrode connected to a second control line, wherein the fifth transistor comprises a first electrode connected to the third node, a second electrode connected to the initializing power source, and a gate electrode connected to the first control line, and wherein the sixth transistor comprises a first electrode connected to the first power source, a second electrode connected to the third node, and a gate electrode connected to the second control line.

3. The pixel circuit of claim 2, wherein the first control line is a scan line connected to the pixel circuit and the second control line is an emission control line connected to the pixel circuit.

4. The pixel circuit of claim 1, wherein the first transistor, the second transistor, the third transistor, the fourth transistor, the fifth transistor, and the sixth transistor are n channel transistors.

5. The pixel circuit of claim 1, wherein the pixel circuit operates in a unit period sequentially comprising a first period, a second period, a third period, and a fourth period, wherein the first transistor, the third transistor, and the fifth transistor are turned-on during the second period in the unit period, and wherein the fourth transistor and the sixth transistor are turned on during the fourth period in the unit period.

6. The pixel circuit of claim 5, wherein, when the first transistor, the second transistor, the third transistor, the fourth transistor, the fifth transistor, and the sixth transistor are turned off during the first period, a voltage of the second node is maintained at a threshold voltage level of the OLED.

7. The pixel circuit of claim 6, wherein, when the third transistor is turned on during the second period, a gate electrode of the second transistor and a second electrode of the second transistor are connected to each other to diode-connect the second transistor.

8. The pixel circuit of claim 1, wherein the initializing power source has a same voltage level as the second power source.

9. The pixel circuit of claim 1, wherein active layers of the first transistor, the second transistor, the third transistor, the fourth transistor, the fifth transistor, and the sixth transistor comprise an oxide semiconductor.

10. An organic light emitting display device comprising:

a plurality of pixel circuits connected to n (n is a natural number of no less than 2) scan lines, m (m is a natural number of no less than 2) data lines, and n control lines;

a scan driver configured to supply a plurality of scan signals to the scan lines;

a data driver configured to supply a plurality of data signals to the data lines; and a control driver configured to supply a plurality of control signals to the control lines, wherein a pixel circuit of the plurality of pixel circuits, the pixel circuit being connected to an ith (i is a positive natural number of no more than n) scan line of the n scan lines, an ith control line of the n control lines, and a jth (j is a positive natural number of no more than m) data line of the m data lines, comprises:

a first transistor connected between the jth data line and a first node and configured to be turned on in response to a scan signal supplied to the ith scan line, the scan signal being one of the plurality of scan signals;

a second transistor connected between a second node and a third node;

a third transistor directly connecting the second node and a fourth node and configured to be turned on in response to the scan signal supplied to the ith scan line;

a fourth transistor directly connecting the first node and the second node and configured to be turned on in response to a control signal supplied to the ith control line, the control signal being one of the plurality of control signals;

a fifth transistor connected between the third node and an initializing power source and configured to be turned on in response to the scan signal supplied to the ith scan line, the fifth transistor directly connected to the third node;

a sixth transistor connected between a first power source and the third node and configured to be turned on in response to the control signal supplied to the ith control line;

a capacitor directly connecting the first node and the fourth node; and an organic light emitting diode (OLED) connected between the second node and a second power source, the second power source and the initializing power source being independent power sources.

11. The organic light emitting display device of claim 10, wherein the first transistor comprises a first electrode connected to the jth data line, a second electrode connected to the first node, and a gate electrode connected to the ith scan line, wherein the second transistor comprises a first electrode connected to the third node, a second electrode connected to the second node, and a gate electrode connected to the fourth node, wherein the third transistor comprises a first electrode connected to the fourth node, a second electrode connected to the second node, and a gate electrode connected to the ith scan line, wherein the fourth transistor comprises a first electrode connected to the first node, a second electrode connected to the second node, and a gate electrode connected to the ith control line, wherein the fifth transistor comprises a first electrode connected to the third node, a second electrode connected to the initializing power source, and a gate electrode connected to the ith scan line, and wherein the sixth transistor comprises a first electrode connected to the first power source, a second electrode connected to the third node, and a gate electrode connected to the ith control line.

12. The organic light emitting display device of claim 10, wherein the first transistor, the second transistor, the third transistor, the fourth transistor, the fifth transistor, and the sixth transistor are n channel transistors.

13. The organic light emitting display device of claim 10, wherein the organic light emitting display device operates in a unit period including a first period, a second period, a third period, and a fourth period, wherein the ith scan line receives the scan signal during the second period, wherein the jth data line receives a data signal of the plurality of data signals during the second period, and wherein the ith control line receives the control signal during the fourth period.

14. The organic light emitting display device of claim 10, wherein the initializing power source has a same voltage level as the second power source.

15. The organic light emitting display device of claim 10, wherein active layers of the first transistor, the second transistor, the third transistor, the fourth transistor, the fifth transistor, and the sixth transistor comprise an oxide semiconductor.

16. A pixel circuit comprising:

a first transistor connected between a data line and a first node;

a second transistor connected between a second node and a third node;

a third transistor connected between the second node and a fourth node;

a fourth transistor connected between the first node and the second node;

a fifth transistor connected between the third node and an initializing power source;

a sixth transistor connected between a first power source and the third node;

a capacitor connected between the first node and the fourth node; and an organic light emitting diode (OLED) connected between the second node and a second power source, the second power source and the initializing power source being independent power sources, wherein the pixel circuit operates in a unit frame sequentially comprising a first period, a second period after the first period, a third period after the second period, and a fourth period after the third period, wherein the first transistor, the third transistor, the fourth transistor, the fifth transistor, and the sixth transistor are turned off during the first period, wherein the first transistor, the third transistor, and the fifth transistor are turned on during the second period to store a data signal received from the data line in the capacitor, and wherein the fourth transistor and the sixth transistor are turned on during the fourth period to control the OLED to emit light in accordance with the data signal stored in the capacitor during the second period.

17. The pixel circuit of claim 16, wherein the fourth transistor and the sixth transistor are turned off during the second period.

18. The pixel circuit of claim 17, wherein the first transistor, the third transistor, and the fifth transistor are turned off during the fourth period.

19. The pixel circuit of claim 18, wherein the first transistor, the third transistor, the fourth transistor, the fifth transistor, and the sixth transistor are turned off during the third period.

20. An organic light emitting display device comprising:

a plurality of pixel circuits connected to n (n is a natural number of no less than 2) scan lines, m (m is a natural number of no less than 2) data lines, and n control lines;

a scan driver configured to supply a plurality of scan signals to the scan lines;

a data driver configured to supply a plurality of data signals to the data lines; and a control driver configured to supply a plurality of control signals to the control lines, wherein a pixel circuit of the plurality of pixel circuits, the pixel circuit being connected to an ith (i is a positive natural number of no more than n) scan line of the n scan lines, an ith control line of the n control lines, and a jth (j is a positive natural number of no more than m) data line of the m data lines, comprises:

a first transistor connected between the jth data line and a first node and configured to be turned on in response to a scan signal supplied to the ith scan line, the scan signal being one of the plurality of scan signals;

a second transistor connected between a second node and a third node;

a third transistor connected between the second node and a fourth node and configured to be turned on in response to the scan signal supplied to the ith scan line;

a fourth transistor connected between the first node and the second node and configured to be turned on in response to a control signal supplied to the ith control line, the control signal being one of the plurality of control signals;

a fifth transistor connected between the third node and an initializing power source and configured to be turned on in response to the scan signal supplied to the ith scan line;

a sixth transistor connected between a first power source and the third node and configured to be turned on in response to the control signal supplied to the ith control line;

a capacitor connected between the first node and the fourth node; and an organic light emitting diode (OLED) connected between the second node and a second power source, the second power source and the initializing power source being independent power sources, wherein the pixel circuit operates in a unit frame sequentially comprising a first period, a second period after the first period, a third period after the second, and a fourth period after the third period, wherein the first transistor, the third transistor, the fourth transistor, the fifth transistor, and the sixth transistor are turned off during the first period, wherein the first transistor, the third transistor, and the fifth transistor are turned on during the second period to store a data signal received from a data line in the capacitor, and wherein the fourth transistor and the sixth transistor are turned on during the fourth period to control the OLED to emit light in accordance with the data signal stored in the capacitor during the second period.

* * * * *